US007946664B2

(12) United States Patent
Vail

(10) Patent No.: US 7,946,664 B2
(45) Date of Patent: May 24, 2011

(54) CORRUGATED SHELF

(75) Inventor: Benjamin F. Vail, Akron, OH (US)

(73) Assignee: Massillon Container Company, Navarre, OH (US)

( * ) Notice: Subject to any disclaimer, the term of this patent is extended or adjusted under 35 U.S.C. 154(b) by 536 days.

(21) Appl. No.: 11/833,482

(22) Filed: Aug. 3, 2007

(65) Prior Publication Data

US 2008/0030113 A1 Feb. 7, 2008

Related U.S. Application Data

(60) Provisional application No. 60/835,692, filed on Aug. 4, 2006.

(51) Int. Cl.
*A47B 47/06* (2006.01)
*A47B 13/00* (2006.01)
*A47B 43/02* (2006.01)

(52) U.S. Cl. ..... 312/259; 108/157.14

(58) Field of Classification Search ..... 108/157.14, 108/180, 165, 51.3, 106, 107, 110; 312/257.1–262; 248/174; 211/149, 135
See application file for complete search history.

(56) References Cited

U.S. PATENT DOCUMENTS

| | | | | | |
|---|---|---|---|---|---|
| 1,776,071 | A * | 9/1930 | Horwath | 108/157.16 |
| 1,852,471 | A * | 4/1932 | Nelson | 108/60 |
| 1,925,673 | A * | 9/1933 | Potter | 108/100 |
| 1,949,913 | A * | 3/1934 | Larkin | 248/174 |
| 2,642,330 | A * | 6/1953 | Armour | 312/257.1 |
| 3,120,826 | A * | 2/1964 | Bowers et al. | 108/101 |
| 3,212,464 | A * | 10/1965 | Steuer | 108/159 |
| 3,729,244 | A * | 4/1973 | Butler | 312/195 |
| 5,394,810 | A * | 3/1995 | Howard et al. | 108/165 |
| 5,669,683 | A * | 9/1997 | Moss et al. | 312/259 |
| 6,135,033 | A * | 10/2000 | Deferrari | 108/165 |
| 7,210,416 | B1 * | 5/2007 | Grigsby, Jr. | 108/165 |
| 2003/0209507 | A1 * | 11/2003 | Dye | 211/149 |

* cited by examiner

*Primary Examiner* — Darnell M Jayne
*Assistant Examiner* — Timothy M Ayres
(74) *Attorney, Agent, or Firm* — Fay Sharpe LLP

(57) ABSTRACT

A shelf unit includes a back wall having first and second end sections. First and second side walls extend outwardly from and in general perpendicular relation to the end sections of the back wall. Each side wall includes at least one first slot. The back wall and first and second side walls are formed from a first board made of a corrugated material. At least one first shelf formed from a second board made of a corrugated material extends between the first and second side walls. The first shelf has opposing end sections which project through the first slot of each side wall for securing the first shelf to the first and second side walls without the need of associated fasteners. The first slot has the same shape as a cross-sectional shape of the first shelf.

11 Claims, 7 Drawing Sheets

CORRUGATED SHELF

CROSS REFERENCE TO RELATED APPLICATIONS

This application claims priority from U.S. Provisional Patent Application Ser. No. 60/835,692 filed Aug. 4, 2006 and is incorporated herein by reference.

BACKGROUND OF THE INVENTION

The present exemplary embodiment relates to a shelf unit, and more particularly to a lightweight, aesthetically pleasing shelf assembly made of corrugated material for economy and strength.

Many different types and styles of shelves are known in the art for supporting and displaying goods. Conventional shelves range from metal units to assemblies made from paperboard and/or other materials. The shelf units commonly available are expensive to purchase or construct, ship, assemble, disassemble, and store. The expense associated with them is due to their weight and large unwieldy size, and the materials from which they are constructed.

Generally, shelf units are constructed of heavy hard to work materials such as wood and metal. They are fastened together with common fasteners such as screws, staples, pins, and metal rods. They often require skilled labor to assemble. In addition, metal and wood units are generally pre-assembled by the manufacturer or are shipped in partially assembled form, thereby requiring excessive shipping space. Moreover, purchasers often do not exercise care when handling and using the shelves and resulting damage requires disposal of the shelves after only a short period of time. Because of the relatively high cost of the metal or wood shelf assembly, this activity increases the cost to the purchaser or to the vendor who supplies the shelves.

Prior art shelves made from paperboard and similar materials oftentimes do not posses adequate strength to support many of the objects placed on them. The shelves are typically attached to the side walls and rear wall through tabs, dowels or other locking devices. The problem is that these devices support the shelves and do not provide sufficient shelf strength. Oftentimes, the consumer uses a paperboard shelf assembly to support objects much heavier than the assembly is designed to handle. As a result, the shelves may experience sagging or even complete failure. To give added strength, is common in the art to provide additional components such as vertical reinforcement ribs or brackets. However, these simply take away shelf space and provide a more complex and expensive shelf assembly. In addition, these extra parts are cumbersome and represent additional parts that need to be assembled and disassembled and transported with the primary shelf assembly.

The present invention contemplates a new and improved shelf assembly which is inexpensive and simple to construct and possesses superior strength, while at the same time providing maximum visibility of the objects displayed. Further, the present invention contemplates an aesthetically pleasing shelf assembly which may be shipped to the point of sale in unassembled form and quickly and easily assembled by the purchaser.

BRIEF DESCRIPTION OF THE INVENTION

In accordance with one aspect, a shelf unit includes a back wall having first and second end sections. First and second side walls extend outwardly from and in general perpendicular relation to the end sections of the back wall. Each side wall includes at least one first slot. The back wall and first and second side walls are formed from a first board made of a corrugated material. At least one first shelf formed from a second board made of a corrugated material extends between the first and second side walls. The first shelf has opposing end sections which project through the first slot of each side wall for securing the first shelf to the first and second side walls without the need of associated fasteners. The first slot has the same shape as a cross-sectional shape of the first shelf.

In accordance with another aspect, a method of forming a shelf unit includes providing a first generally rectangular corrugated paper board. The first board is divided longitudinally into a first end section, an intermediate section and a second end section by fold lines. The first and second end sections define respective first and second side walls. The intermediate section defines a rear wall. At least one first slot is formed in the first and second end sections. The first board is folded along the fold lines so that the first and second end sections extend outwardly from and in perpendicular relation to the intermediate section. At least one second generally rectangular corrugated paper board is provided. The second board is divided longitudinally into a plurality of sections by fold lines. The second board is folded along the fold lines to form a first shelf having a generally triangular shape. The folded second board is inserted through the first slot such that the second board extends between the first and second end sections of the first board. Opposing ends of the second board project through the first slot of each first board end section.

In accordance with yet another aspect, a shelf unit comprises a back wall having opposing end sections and first and second side walls extending generally perpendicular from the respective end sections of the back wall. Each side wall includes first and second slots. The back wall and first and second side walls are formed from a first corrugated paper board. A first shelf has opposing end sections projecting through the first slot of each first and second side wall. The first slot has a shape similar to a cross-sectional shape of the first shelf. The first shelf is formed from a second corrugated paper board. A second shelf has opposing end sections projecting through the second slot of each first and second side wall. The second shelf has a cross-sectional shape different than the cross-sectional shape of the first shelf. The second shelf is formed from a third corrugated paper board.

In accordance with still yet another aspect, a shelf unit includes four shelves, three of which are identical having a triangular shape. Each of the first three shelves are formed from a rectangular flat piece of corrugated board. Opposing longitudinal ends of the board are folded downwardly forming first and second vertical supports which are in perpendicular relation to the board. Opposing longitudinal ends are folded downwardly again until the vertical supports are in face to face relation with one another and the ends of the supports are in direct contact with the bottom side of the board. Each of the corrugated boards take on a generally triangular shape and together constitute the top three shelves of the shelf unit.

The fourth shelf, which is the bottom shelf, is also formed from a flat piece of corrugated board. One longitudinal end is folded downwardly forming a support which is in perpendicular relation to the board. The same end is folded again until the end of the support is in direct contact with the bottom side of the board. The opposing longitudinal end is folded downwardly forming a vertical footer which is in perpendicular relation to the horizontal corrugated board. The footer of the bottom shelf sits on the floor to add strength to the support unit.

The side walls and back wall are formed of one flat piece of corrugated board. The corrugated board is folded so that two side walls are formed in perpendicular relation to a back wall. The side walls have four pairs of opposing slots for receiving and supporting each of the shelves.

The present shelf unit can be shipped in unassembled form, comprising only five separate components that may be quickly and easily assembled. The components include flat blanks, one of which is folded to form the rear wall and side walls while the other four are folded to form shelves. The shelves are secured to the side walls by the use of slots, eliminating the need for separate fasteners such as staples, glue or tape.

A benefit of the invention resides in the ability to provide an attractive, lightweight, and strong shelf unit constructed of heavy duty corrugated paper board.

Another benefit of the invention resides in the ability to provide a low cost shelf unit that can be disposed of or re-used should the user so choose.

Still another benefit resides in the ability to provide a shelf unit that is easy to assemble for the user so that no tools or expertise is required, and yet it is stronger than comparable conventional shelf units made from paperboard. In addition, it is even stronger than some of the shelf assemblies made of metal.

Still other non-limiting benefits and/or aspects of the disclosure will become apparent from reading and understanding the description of the preferred embodiments below.

BRIEF DESCRIPTION OF THE DRAWINGS

The present invention may take physical form in certain parts and arrangements of parts, several embodiments of which will be described in detail in this specification and illustrated in the accompanying drawings which form a part of the invention.

DETAILED DESCRIPTION OF THE PREFERRED EMBODIMENTS

It should, of course, be understood that the description and drawings herein are merely illustrative and that various modifications and changes can be made in the structures disclosed without departing from the spirit of the invention. Like numerals refer to like parts throughout the several views.

Figure 1:
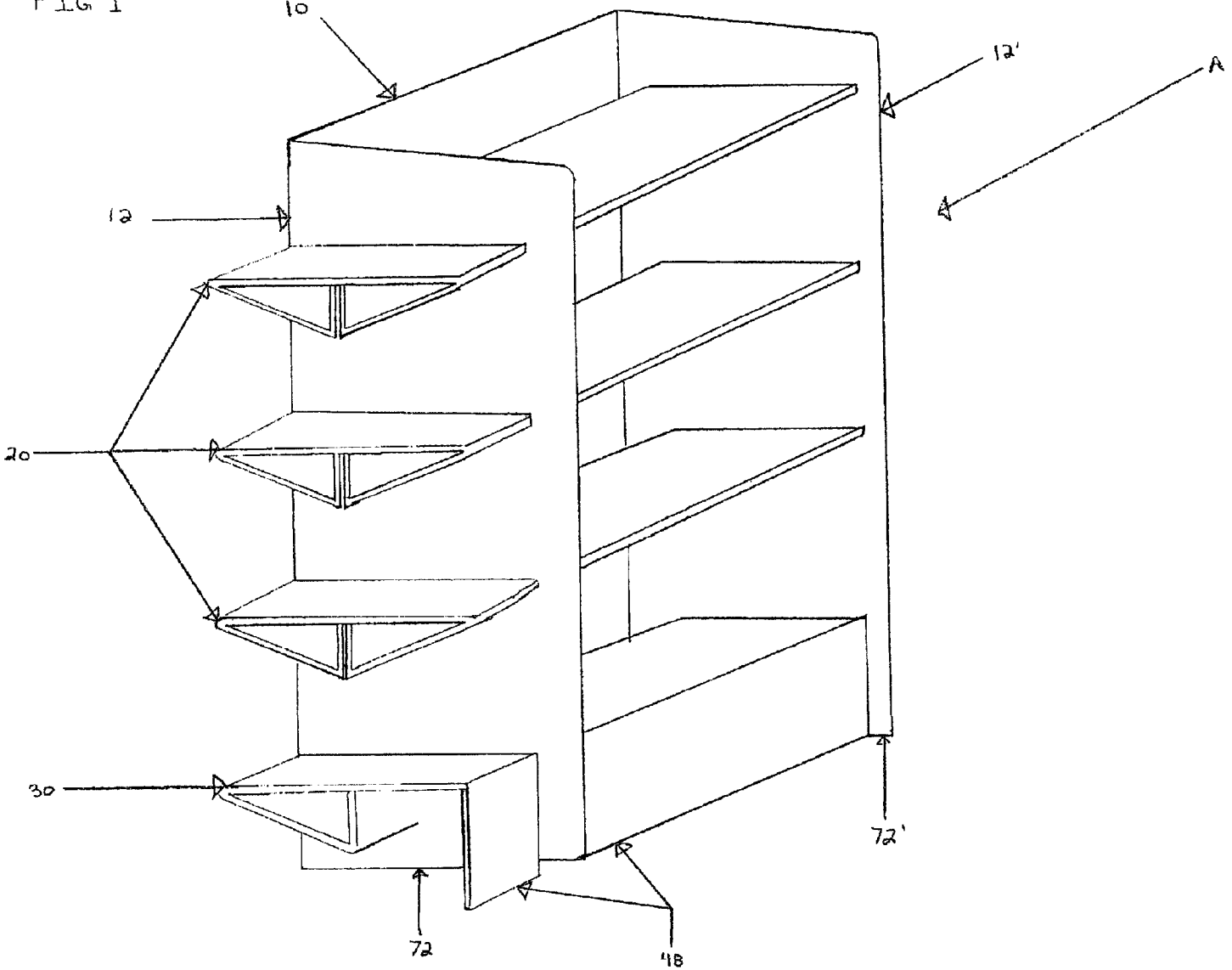
FIG. 1 is a perspective view of one of the shelf units in accordance with one embodiment of the present invention.

Referring now to the drawings wherein the showings are for purposes of illustrating the preferred and alternate embodiments of the invention only and not for purposes of limiting same, a fully assembled freestanding shelf unit A according to one embodiment of the present invention is indicated generally in FIG. 1. The shelf unit A is made from heavy duty corrugated board having at least one layer of corrugations and is adapted to support objects such as books, pictures, decorative items, or any other desired objects. In this embodiment, the corrugated board is comprised of two layers of corrugations.

More particularly, with reference to FIG. 1, the shelf unit A includes a back wall 10 and two side walls 12,12' which together provide the outer frame of the shelf unit A. The shelf unit further includes at least one first shelf and a second shelf. In the depicted embodiment, a plurality of generally vertically aligned, spaced apart, horizontal shelves 20,30 extend between and are supported by the side walls 12,12'. The shelves 20,30 provide maximum exposure of the objects supported and displayed on the shelves. The upper three first shelves 20 are generally identical having a generally triangular shape while the bottom second shelf 30 takes on a different orientation. In FIG. 1, the shelf unit A is shown erect in an orientation in which it would normally rest on a floor. The shelf unit A rests on the lower rear wall edge (not shown) the side wall edges 72,72' and the footer 48.

Figure 2:
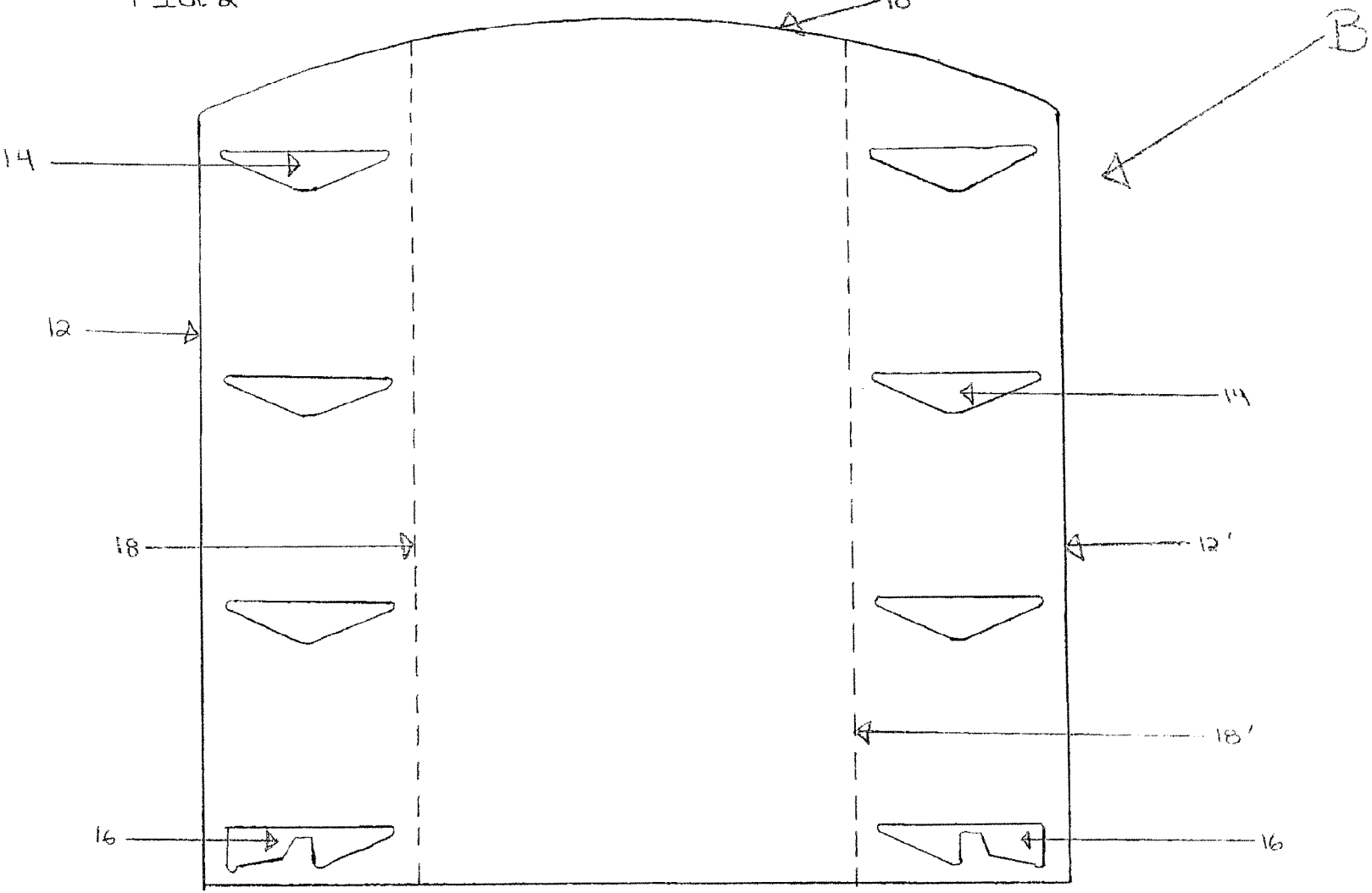
FIG. 2 is a plan view of an unassembled blank used to form a back wall and two side walls of the shelf unit of FIG. 1.

With reference to FIG. 2, the rear wall 10 and side walls 12,12' are formed from a large flat generally rectangular blank piece of corrugated paper board B vertically divided by two fold lines 18,18' splitting the flat blank into three sections 10,12,12'. The three sections define the side walls 12,12' and the rear wall 10. The blank rectangular board B is folded along fold lines 18,18' so that the side walls 12,12' extend outwardly from and in generally perpendicular relation to opposing ends of the back wall 10. Each side wall 12,12' has three generally identical generally triangular slots 14, vertically aligned and cut from the side walls 12,12' for receiving and supporting the upper shelves 20. Each side wall 12,12' has an additional slot 16 located at the bottom of the side walls 12,12' for receiving and supporting the bottom shelf 30.

Figure 3:
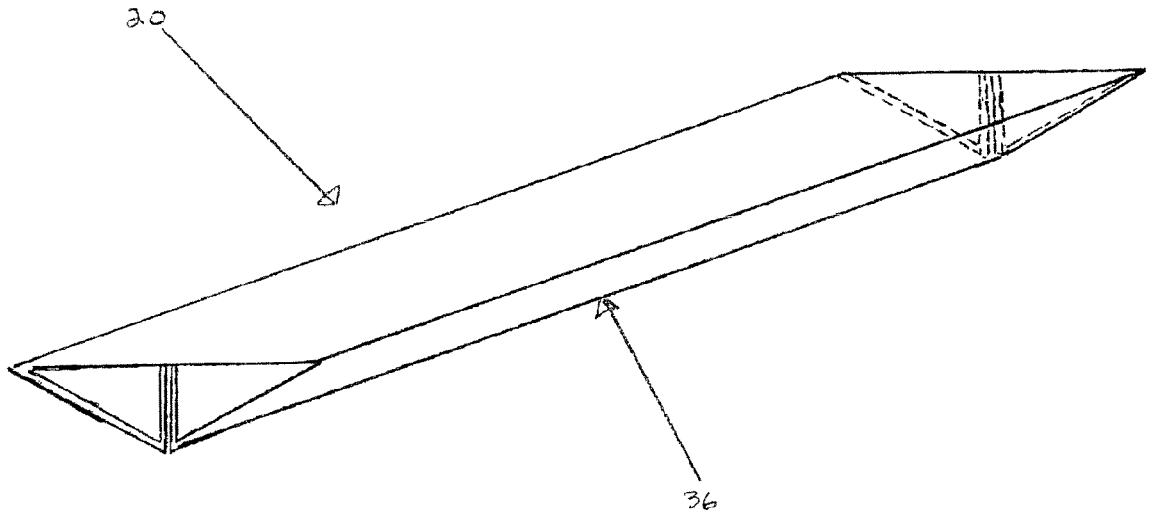
FIG. 3 is a perspective view of one of the upper three shelves of the shelf unit of FIG. 1
Figure 4:
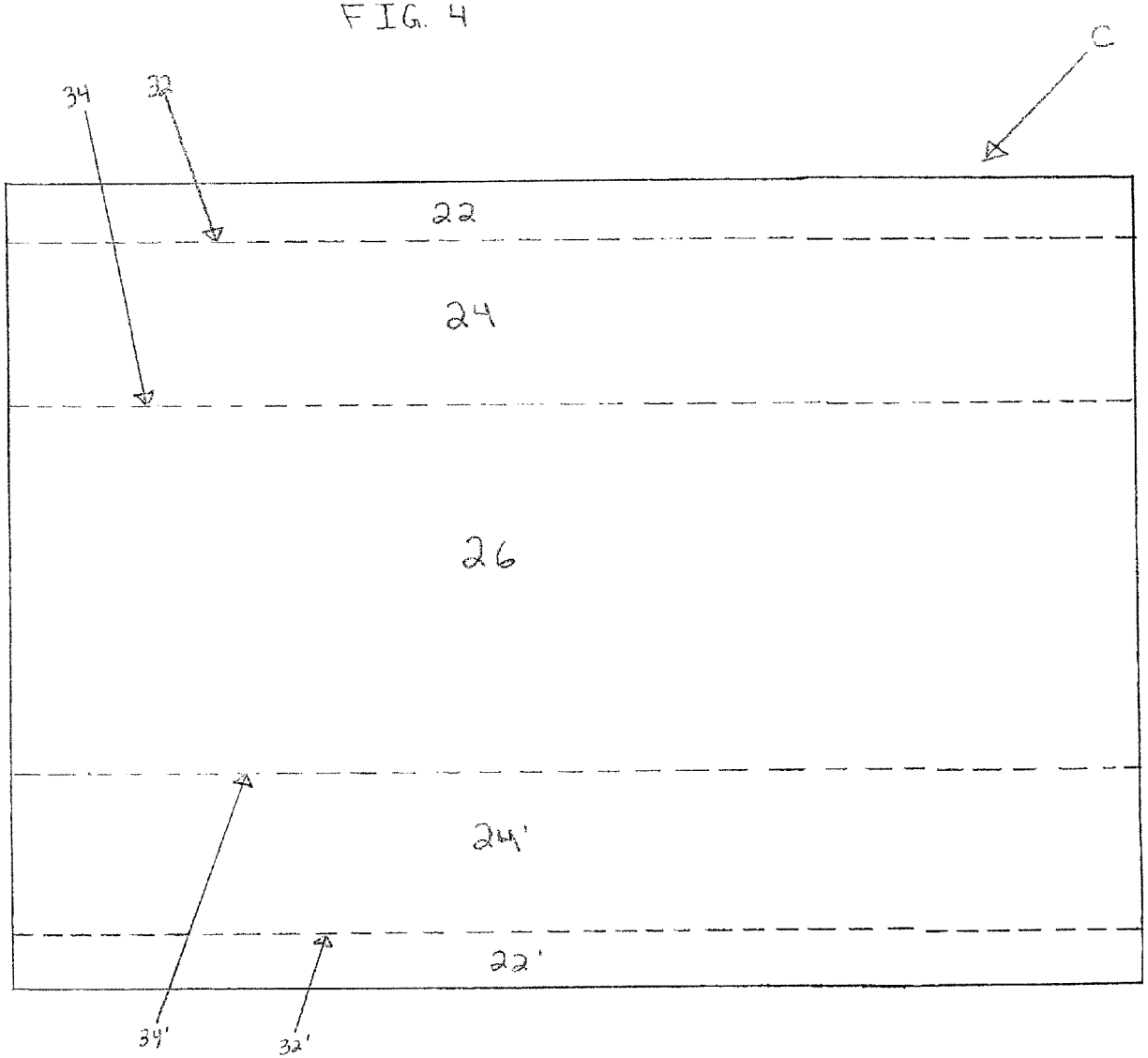
FIG. 4 is a plan view of an unassembled blank used to form one of the upper three shelves of the shelf unit of FIG. 1.

FIG. 3 illustrates one of the fully assembled upper shelves 20 constructed from corrugated paper board which is adapted to support any variety of objects. With reference to FIG. 4, an upper shelf 20 is formed from a large flat rectangular blank piece of corrugated paper board C divided longitudinally into five sections 22,22',24,24', 26. First and second sections 22,22' are supports which are folded downwardly along fold lines 32,32' until they are in generally perpendicular relation to the flat board C. Third and fourth sections 24,24' are then folded downwardly along fold lines 34,34' until the first and second sections 22,22' are in face to face relation and the ends of the first and second sections 22,22' are in contact with the bottom side of the shelf 20 forming a generally triangular bracket 36. A fully assembled upper shelf 20 is illustrated in FIG. 3.

Figure 5:
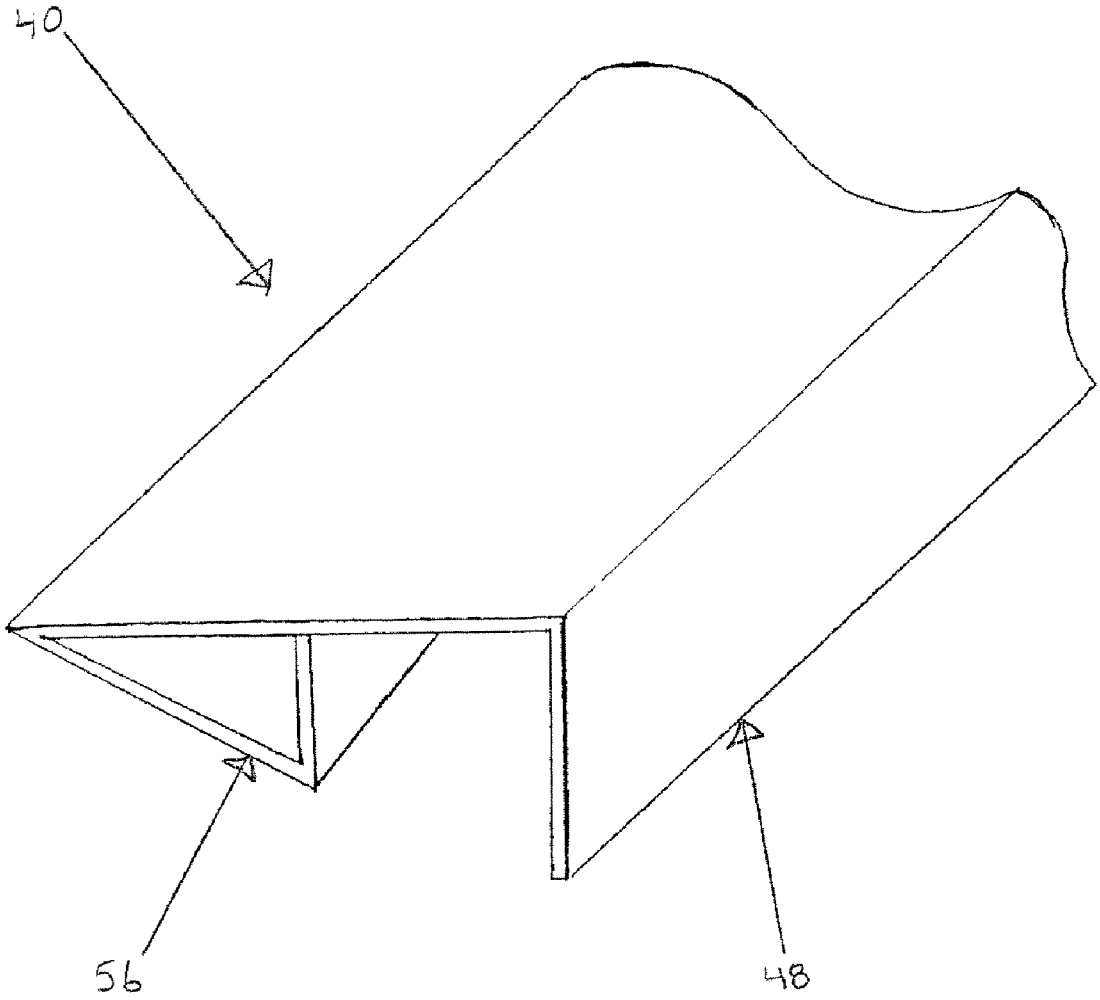
FIG. 5 is a partial perspective view of the bottom shelf of the shelf unit of FIG. 1.
Figure 6:
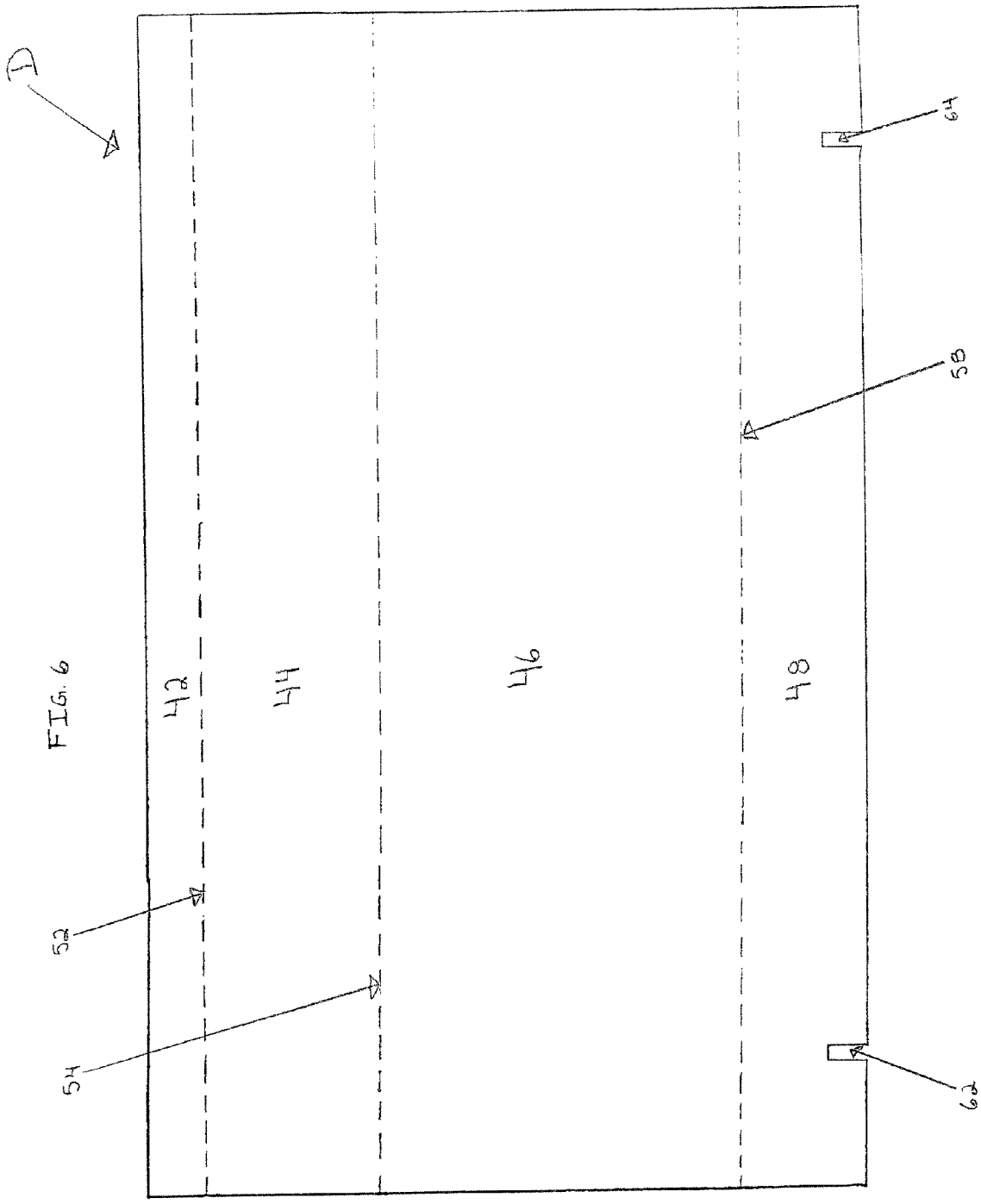
FIG. 6 is a plan view of an unassembled blank used to form a bottom shelf of the shelf unit of FIG. 1.

FIG. 5 illustrates a fully assembled bottom shelf 40 constructed from corrugated paper board which is adapted to act as a shelf and also add strength to the shelf unit A. With reference to FIG. 6, the bottom shelf 40 is formed from a large flat rectangular blank piece of corrugated paper board D divided longitudinally into three sections 42,44,46, and a footer 48. First section 42 is a support and is folded downwardly along a fold line 52 until it is in generally perpendicular relation to the flat board D. Second section 44 is then folded downwardly along a fold line 54 until the end of the support 42 is in direct contact with the bottom of the third section 46 forming a generally triangular bracket 56. The third section 46 acts as the top of the bottom shelf 40. The footer 48 is folded downwardly along a fold line 58 until it is in generally perpendicular relation to the third section 46. A fully assembled bottom shelf 40 is illustrated in FIG. 5.

The upper shelves 20 of the shelf unit A which have a generally triangular shape are inserted into generally triangular slots 14 of each side wall 12,12' and the shelves 20 are supported by the side walls 12,12'. The bottom shelf 40 is also inserted into a slot 16 wherein the shape of the slot 16 is generally the same as the shape of the bottom shelf 40. The footer 48 includes first and second notches 62, 64 which receive part of the side walls 12,12' and act as a locking device to secure the footer 48 in place. The footer 48 traverses the lower front or face portion of the shelf unit A and rests on the floor or associated subjacent surface to provide added strength to the shelf unit A. A fully assembled shelf unit A is illustrated in FIG. 1.

Figure 7:
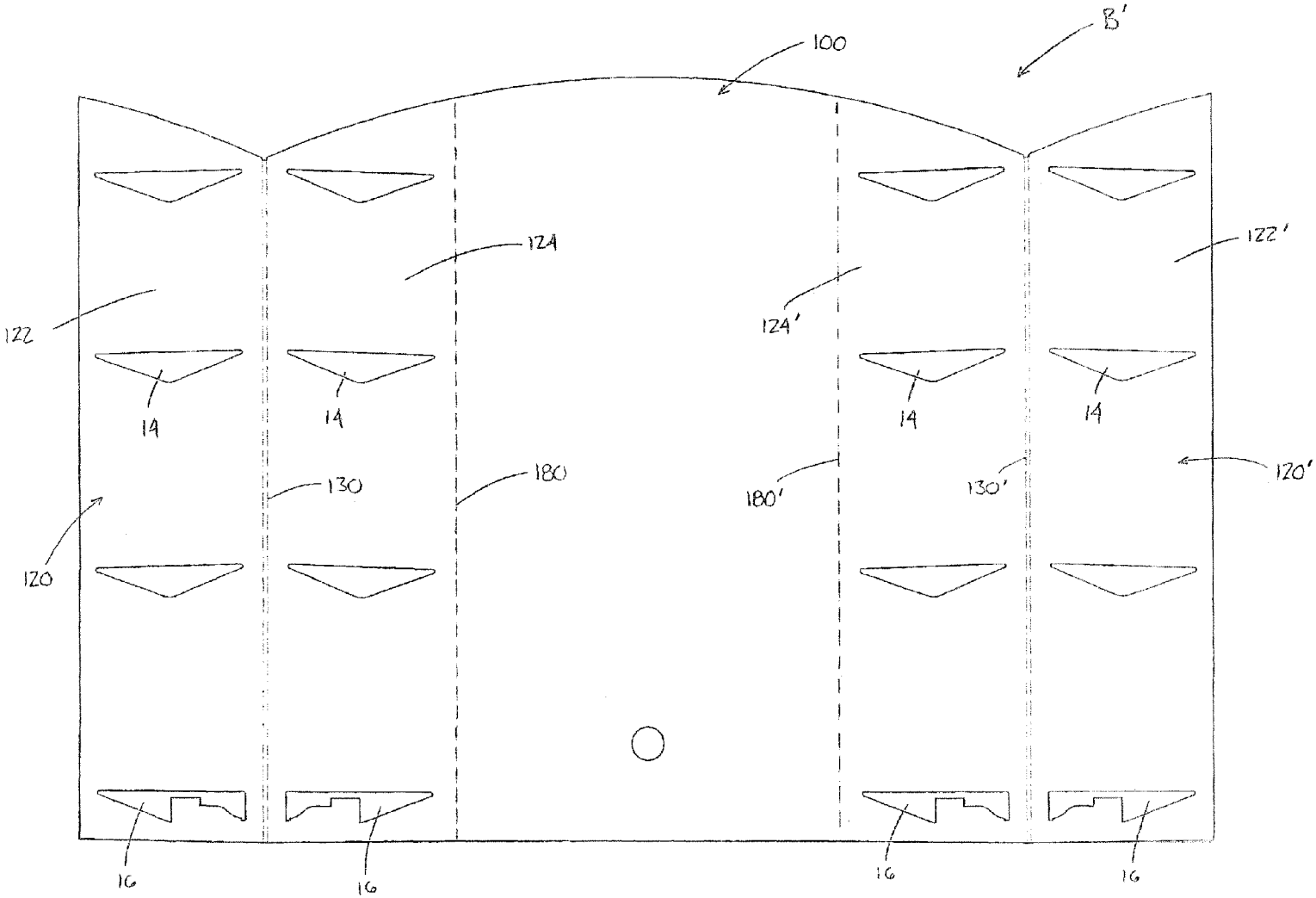
FIG. 7 is a plan view of an unassembled blank used to form a back wall and two side walls of a shelf unit in accordance with another embodiment of the present invention.

Similar to the aforementioned embodiment, a second embodiment of an unassembled shelf unit is shown in FIG. 7. Similar to the first embodiment, the shelf unit is made from heavy duty corrugated board and is adapted to support objects such as books, pictures, decorative items, or any other desired objects. However, in this embodiment, the corrugated board is comprised of a single layer of corrugations.

With reference to FIG. 7, the shelf unit (not shown in assembled form) includes a back wall 100 and two side walls 120,120' which together provide the outer frame of the shelf unit. The rear wall 100 and side walls 120,120' are formed from a large flat generally rectangular blank piece of corrugated paper board B' vertically divided by two fold lines 180,180' splitting the flat blank into three sections 100,120, 120'. The three sections define the side walls 120,120' and the rear wall 100.

The blank rectangular board B is folded along fold lines 180,180' so that the side walls 120,120' extend outwardly from and in generally perpendicular relation to opposing ends of the back wall 100. Each side wall 120,120' comprises a first section 122,122' and a second section 124,124'. The first and second sections are vertically divided by two fold lines 130, 130'. Each section has three generally identical triangular slots 140, generally vertically aligned and cut from the side walls 120,120' for receiving and supporting the upper shelves 20 (FIG. 1). Each section has an additional slot 160 located at the bottom of the side walls 120,120' for receiving and supporting the bottom shelf 30 (FIG. 1). It should be appreciated that the generally triangular slots 140 and the additional slot 160 can be tilted slightly to the back wall (in the assembled form). This, in turn, will tilt the upper shelves 20 and the bottom shelf 30 slightly back to add additional stability to the shelf unit.

Each side wall 120,120' is folded along the fold line 130, 130' so that a face of the second section 124,124' is adjacent a face the first section 122,122'. Once folded, the triangular slots 140 and the additional slot 160 of the first section are aligned with the triangular slots 140 and the additional slot 160 of the second section. Moreover, the folding of the second section onto the first section doubles the thickness of the of the sidewalls 120,120' (i.e. two layers of corrugated board which is similar to the first embodiment) and hides the corrugations from the view of the user standing in front of the assembled shelf unit.

As to a further discussion of the manner of assembly of the shelf unit of the second embodiment, the same should be apparent from the above description relative to the first embodiment. Accordingly, no further discussion relating to the assembly will be provided.

The present disclosure has been described with reference to the preferred embodiments. Obviously, modifications and alterations will occur to others upon reading and understanding the preceding detailed description. For example, it will be appreciated that the triangular slots and the corresponding triangular shape of the shelf (when folded) could be an alternative shape such as a rectangular configuration. It is intended that the disclosure be construed as including all such modifications and alterations insofar as they come within the scope of the appended claims or the equivalents thereof.

What is claimed is:

1. A shelf unit comprising:

a back wall having opposing end sections;

first and second side walls extending generally perpendicular from the respective end sections of the back wall, each side wall including first and second slots, the back wall and first and second side walls being formed from a first corrugated paper board;

a first shelf having opposing end sections projecting through the first slot of each first and second side wall, respectively, the first slot having a shape similar to a cross-sectional shape of the first shelf, and being formed from a second corrugated paper board; and a second shelf having opposing end sections projecting through the second slot of each first and second side wall, respectively, the second shelf having a cross-sectional shape different than the cross-sectional shape of the first shelf, and being formed from a third corrugated paper board, the second shelf having a generally horizontal support, first and second generally vertical supports, the generally vertical supports being spaced apart, the second generally vertical support traversing a face portion of the shelf unit, and the second slot having an irregular shape that is contoured to permit the second shelf to pass therethrough when the second vertical support is disposed in an acute angled configuration and subsequently deployed to the generally vertical support position relative to the generally horizontal support.

2. The shelf unit of claim 1, wherein the generally vertical support includes first and second generally vertical supports in face to face relation with one another, an end of each support engaging a bottom surface of the generally horizontal support.

3. The shelf unit of claim 1, wherein the second shelf is formed from a third board made of a corrugated material and having a cross-sectional shape different than the cross-sectional shape of the first shelf.

4. The shelf unit of claim 3, wherein the first and second generally vertical supports of the second shelf are spaced apart and an end of each generally vertical support engages a bottom surface of the generally horizontal support.

5. The shelf unit of claim 4, wherein the second generally vertical support traverses a lower front of the shelf unit, and an opposing end of the second generally vertical support engages an associated subjacent surface providing added strength to the shelf unit.

6. The shelf unit of claim 4, wherein the second shelf includes a locking device for securing the second shelf to the first and second side walls.

7. The shelf unit of claim 6, wherein the locking devices includes at least one notch located on the second generally vertical support for receiving a portion of one of the first and second side walls.

8. The shelf unit of claim 3, wherein the second shelf includes a generally triangular shaped first section and an inverted L-shaped second section.

9. The shelf unit of claim 3, wherein the second slot has the same shape as the cross-sectional shape of the second shelf.

10. The shelf unit of claim 1, wherein the first shelf has a generally triangular cross-sectional shape, the first shelf including a generally horizontal support and first and second generally vertical supports, the first and second generally vertical supports being in face to face relation with one another.

11. The shelf unit of claim 1, wherein the second shelf includes a locking device for securing the second shelf to the first and second side walls.

* * * * *